US011577929B2

(12) United States Patent
Tsuji

(10) Patent No.: US 11,577,929 B2
(45) Date of Patent: Feb. 14, 2023

(54) STACKING DEVICE AND IMAGE FORMING APPARATUS

(71) Applicant: CANON KABUSHIKI KAISHA, Tokyo (JP)

(72) Inventor: Hiroharu Tsuji, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/669,530

(22) Filed: Feb. 11, 2022

(65) Prior Publication Data

US 2022/0162032 A1 May 26, 2022

Related U.S. Application Data

(62) Division of application No. 16/542,384, filed on Aug. 16, 2019, now Pat. No. 11,279,585.

(30) Foreign Application Priority Data

Aug. 22, 2018 (JP) ..... JP2018-155806

(51) Int. Cl.
*B65H 31/26* (2006.01)
*B65H 31/02* (2006.01)

(52) U.S. Cl.
CPC ..... *B65H 31/26* (2013.01); *B65H 31/02* (2013.01)

(58) Field of Classification Search
None
See application file for complete search history.

(56) References Cited

U.S. PATENT DOCUMENTS 6,412,774 B1 7/2002 Saito et al.
7,212,751 B2 5/2007 Kayama et al.
7,270,324 B2 9/2007 Ogata et al.
7,526,244 B2 4/2009 Kayama et al.
(Continued)

FOREIGN PATENT DOCUMENTS

CN 1577141 A 2/2005
CN 1636751 A 7/2005
(Continued)

OTHER PUBLICATIONS

Search Report dated Jul. 3, 2020, in European Patent Application No. 19192859.7.
(Continued)

*Primary Examiner* — Leslie A Nicholson, III
(74) *Attorney, Agent, or Firm* — Venable LLP

(57) ABSTRACT

A stacking device which is detachably attached to an apparatus body of an image forming apparatus having an abutting member that abuts on a recording material and on which a recording material is stacked includes: a first supporting unit that supports the recording material from a lower side of the recording material; and a second supporting unit that supports an end of the recording material in an attachment/detachment direction of the stacking device. The second supporting unit includes a corresponding region, and a position of the corresponding region agrees with a position of the abutting member abut with the recording material in a width direction which is orthogonal to the attachment/detachment direction. At least a height of the corresponding region in a direction orthogonal to the attachment/detachment direction and the width direction is lower than a height of the abutting member.

8 Claims, 8 Drawing Sheets

(56) References Cited

U.S. PATENT DOCUMENTS

| | | | |
|---|---|---|---|
| 7,697,883 | B2 | 4/2010 | Ogata et al. |
| 7,850,161 | B2 | 12/2010 | Fukatsu et al. |
| 7,860,412 | B2 | 12/2010 | Kayama et al. |
| 7,963,523 | B2 | 6/2011 | Koshimura et al. |
| 8,170,463 | B2 | 5/2012 | Ogata et al. |
| 8,360,421 | B2 | 1/2013 | Tsuji et al. |
| 9,309,075 | B2 | 4/2016 | Ochi et al. |
| 2005/0141939 | A1 | 6/2005 | Kayama et al. |
| 2007/0126174 | A1 | 6/2007 | Kayama et al. |
| 2009/0185812 | A1 | 7/2009 | Kayama et al. |
| 2017/0248888 | A1 | 8/2017 | Izumichi |
| 2020/0122951 | A1 | 4/2020 | Noda et al. |

FOREIGN PATENT DOCUMENTS

| | | | |
|---|---|---|---|
| JP | 2002-274727 | A | 9/2002 |
| JP | 2003-300661 | A | 10/2003 |
| JP | 2005-206373 | A | 8/2005 |
| JP | 2010-173848 | A | 8/2010 |

OTHER PUBLICATIONS

Office Action dated Apr. 26, 2021, in Chinese Patent Application No. 201910761687.3.

Espacenet machine translation of JP2002274727A; http://translationportal.epo.org/emtp/translate/?ACTION=description-retrieval&COUNTRY=JP&ENGINE=google&FORMAT=docdb&KIND=A&LOCALE=en EP&NUMBER=2002274727&OPS=ops.epo.org/3.2&SRCLANG=ja&TRGLANG=en (Year: 2002).

STACKING DEVICE AND IMAGE FORMING APPARATUS

This is a divisional of U.S. patent application Ser. No. 16/542,384, filed Aug. 16, 2019.

BACKGROUND OF THE INVENTION

Field of the Invention

The present invention relates to a stacking device on which sheets are stacked and which is provided in an image forming apparatus or a sheet post-processing device mounted in the image forming apparatus.

Description of the Related Art

Conventionally, a discharged sheet stacking unit on which sheets as recording materials are stacked is provided in an image forming apparatus or a sheet post-processing device as a stacking device. The discharged sheet stacking unit includes a sheet stacking unit on which sheets are stacked and a conveying unit that discharges sheets onto the sheet stacking unit. As an example of a stacking device, a device in which a rear end wall provided on an upstream end side (a sheet rear end side) in a conveying direction of stacked sheets is integrated with a sheet stacking unit and can be separated from a conveying unit is known. This configuration is effective in creating a space for users to access a jammed sheet during clearing of a paper jam, for example. Japanese Patent Application Publication No. 2002-274727 discloses a stacking device which further includes an abutting member as a configuration that abuts on a sheet stacked on a sheet stacking unit in addition to the rear end wall and the sheet stacking unit which are integrated. This abutting member is configured to abut on a sheet stacked on the sheet stacking unit from an upper side so that a sheet abutting position changes according to the height of the stacked sheet. However, in the device configuration disclosed in Japanese Patent Application Publication No. 2002-274727, when the sheet stacking unit and the rear end wall are separated from the conveying unit during clearing of a paper jam so as to return to original positions, the rear end wall and the abutting member interfere with each other. Therefore, in Japanese Patent Application Publication No. 2002-274727, a cam shape is provided in a portion of the rear end wall making contact with the abutting member to avoid interference so that the abutting member moves along the cam shape when the rear end wall returns to the original position. However, since the abutting member moves in a state of continuously making contact with the cam shape, when there is an impact (for example, when the rear end wall returns to the original position with great power), the abutting member may be broken without following the cam shape.

SUMMARY OF THE INVENTION

However, a stacking device which includes a detection flag for detecting the height of a sheet stacked on a sheet stacking unit, for example, in addition to a sheet pressing member as a configuration that presses sheets stacked on the sheet stacking unit is known. The detection flag is also configured so that the sheet abutting position changes according to the height of a stacked sheet similarly to the sheet pressing member. Therefore, when the sheet stacking unit and the rear end wall are separated from the conveying unit so as to return to the original positions during clearing of a paper jam, problems similar to those of a device having the sheet pressing member occur.

Therefore, the present invention has been made in view of such a situation. That is, an object of the present invention is to provide a stacking device which can be detachably attached to an image forming apparatus body without breaking an abutting member that abuts on a recording material stacked on the stacking device even when an operation of pulling or returning the stacking device with great power when the stacking device is attached to or detached from the apparatus body.

In order to attain the object, a stacking device, which is detachably attached to an apparatus body of an image forming apparatus including the apparatus body having an abutting member that abuts on a stacked recording material and on which a recording material discharged from the apparatus body is stacked, according to the present invention includes:

a first supporting unit that supports the recording material from a lower side of the recording material; and a second supporting unit that supports an end of the recording material in an attachment/detachment direction which is a direction in which the stacking device is attached to and detached from the apparatus body, wherein the second supporting unit includes a corresponding region, and a position of the corresponding region agrees with a position of the abutting member abut with the recording material in a width direction which is orthogonal to the attachment/detachment direction, and wherein at least a height of the corresponding region in a direction orthogonal to the attachment/detachment direction and the width direction is lower than a height of the abutting member.

In order to attain the object, an image forming apparatus according to the present invention includes:

an image forming unit that forms an image on a recording material;

the stacking device described above, and an abutting member that abuts on the recording material stacked on the stacking device.

In order to attain the object, an image forming apparatus according to the present invention includes:

an image forming unit that forms an image on a recording material;

a stacking device on which the recording material on which an image is formed by the image forming unit is stacked and which is detachably attached to an apparatus body of the image forming apparatus, the stacking device including a first supporting unit that supports the recording material from a lower side of the recording material and a second supporting unit that supports an end of the recording material in an attachment/detachment direction in which the stacking device is attached to and detached from the apparatus body;

a control unit that controls conveying of the recording material in the image forming apparatus;

a first abutting member that abuts on the recording material stacked on the stacking device and is configured such that an abutting position of abutting on the recording material stacked on the stacking device changes according to a height of the stacked recording materials; and a second abutting member that abuts on the recording material stacked on the stacking device and is configured such that an abutting position of abutting on the recording material stacked on the stacking device is located closer to the end supported by the second supporting unit than the abutting position between the first abutting member and the recording material and changes according to the height of the stacked recording materials, wherein the control unit performs control so that conveying of the recording material to the stacking device is stopped when either one of the first abutting member or the second abutting member abuts on the recording material at a maximum height position at which the recording material can be supported by the second supporting unit in a direction orthogonal to the attachment/detachment direction and the width direction of the recording material.

According to the present invention, it is possible to provide a stacking device which can be detachably attached to an image forming apparatus body without breaking an abutting member that abuts on a recording material stacked on the stacking device even when an operation of pulling or returning the stacking device with great power when the stacking device is attached to or detached from the apparatus body.

Further features of the present invention will become apparent from the following description of exemplary embodiments with reference to the attached drawings.

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

Embodiment 1

Figure 1:
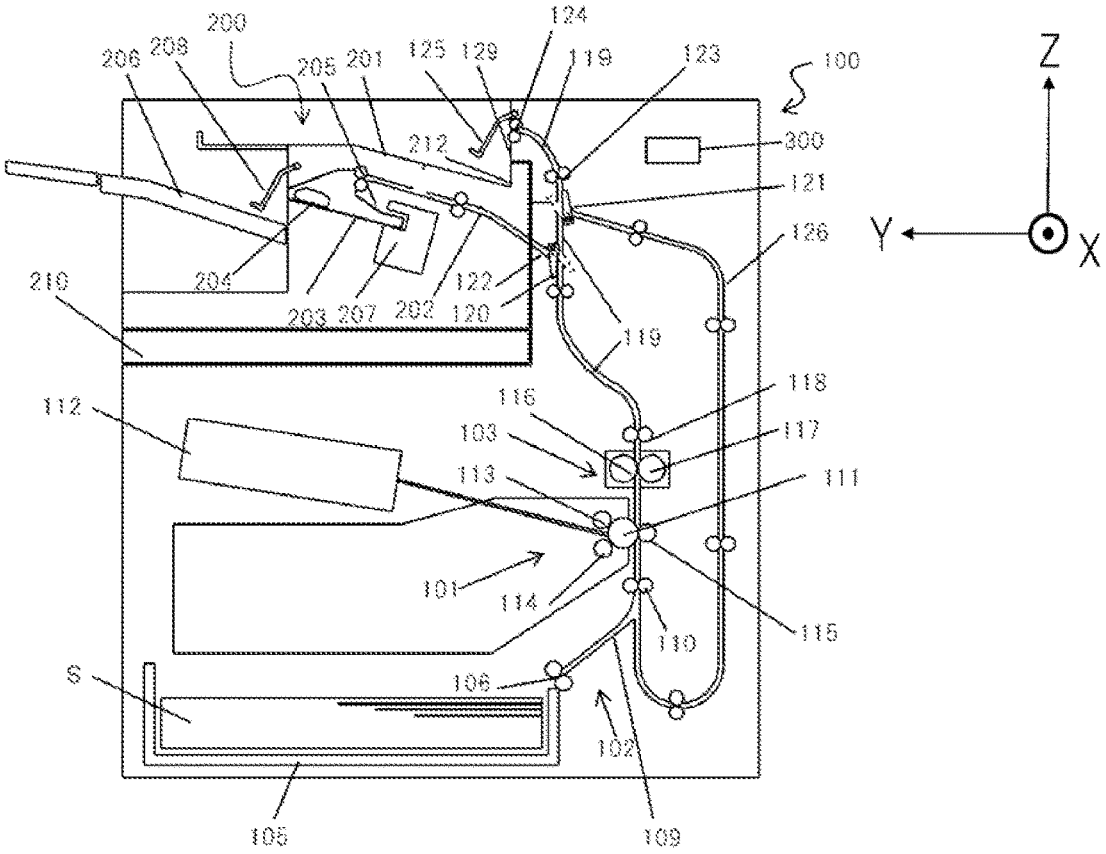
FIG. 1 is a schematic cross-sectional view of an image forming apparatus and a sheet post-processing device.

Hereinafter, a preferred embodiment of the present invention will be described with reference to the drawings. FIG. 1 illustrates a schematic cross-sectional view of a monochrome digital printer as an example of an image forming apparatus to which the present invention is applied. In FIG. 1, reference numeral 100 is an image forming apparatus body (hereinafter referred to as an apparatus body). A sheet post-processing device 200 is attached to a left upper portion of the apparatus body 100. The sheet post-processing device 200 corresponds to a stacking device of the present embodiment. That is, an image forming apparatus of the present embodiment includes the apparatus body 100 and the sheet post-processing device 200. In the present embodiment, a configuration portion excluding the sheet post-processing device 200 among the configurations of the image forming apparatus is the apparatus body 100.

In the following description and the components illustrated in the drawings, the directions up, down, left, and right are directions assuming when an image forming apparatus is installed on a horizontal surface as a normal installation state.

The apparatus body 100 includes an image forming unit 101. Reference numeral 102 is a sheet feeding unit that feeds sheets to the image forming unit 101, and reference numeral 103 is a fixing unit that fixes an image to a sheet.

Here, the image forming unit 101 includes a photosensitive drum 111 that rotates in a clockwise direction in FIG. 1, an exposure device 112, and a charging roller 113, a developing device 114, and a transfer roller 115 arranged substantially sequentially along a rotation direction of the photosensitive drum 111. The image forming unit 101 forms a toner image on a sheet S according to an image forming process.

That is, first, after the surface of the photosensitive drum 111 as an image bearing member is uniformly charged to a predetermined polarity by the charging roller 113, a latent image is formed on the photosensitive drum 111 by the exposure device 112 on the basis of the image data of an image to be formed on the sheet S which is a recording material. The developing device 114 causes toner to adhere to the latent image which is formed on the surface of the photosensitive drum 111 as a toner image. The toner image formed on the photosensitive drum 111 is conveyed to a transfer nip formed by the transfer roller 115 and the photosensitive drum 111. Moreover, the sheet S as a recording material is delivered from a sheet feeding cassette 105 through a sheet feeding roller 106. The delivered sheet S passes through a conveying guide 109 and a registration roller 110 and is conveyed to a transfer nip formed by the transfer roller 115 and the photosensitive drum 111 which is an image bearing member. In the transfer nip, a high voltage of a polarity opposite to a normal charging polarity of the toner is applied, and a toner image on the photosensitive drum 111 is transferred to the sheet S. The image forming process is performed in this manner. After that, the sheet S having the toner image transferred thereto is conveyed to the fixing unit 103 to be described later and is heated and pressurized by a fixing roller 116 and a pressure roller 117 whereby the toner image is fixed to the sheet S.

The sheet feeding unit 102 includes a sheet feeding cassette 105 in which a plurality of sheets S as a recording material provided for printing are stored in a stacked state, the sheet feeding roller 106, the conveying guide 109, the registration roller 110, and the like. The fixing unit 103 includes the fixing roller 116, the pressure roller 117 that abuts on the fixing roller 116, and a conveying roller 118. Reference numeral 119 is a first sheet conveying path and a sheet leaving the conveying roller 118 is conveyed while being guided by the first sheet conveying path 119.

A first conveying path switching member 120 and a second conveying path switching member 121 are provided in the first sheet conveying path 119. The positions indicated by a solid line in the drawing are the home positions of the first and second conveying path switching members 120 and 121.

When the first conveying path switching member 120 is switched from the position indicated by a solid line in the drawing to a position indicated by a broken line by an actuator (not illustrated) and is held in that position, the sheet S is conveyed to the sheet post-processing device 200 while being guided by the second sheet conveying path 122. An inversion roller 123 and a discharge roller 124 are provided in the first sheet conveying path 119. The sheet S discharged from the discharge roller 124 is stacked on a first stacking unit 201 corresponding to a first supporting unit, positioned on a top surface of the sheet post-processing device 200 and is supported from a lower side. A first full detection flag 125 as a detection unit is provided on an upper side of the first stacking unit 201 so as to detect whether sheets are stacked on the first stacking unit 201 up to a predetermined height or higher. In a period in which the first full detection flag 125 detects that sheets are stacked up to a predetermined height or higher, a control unit 300 performs control so that conveying of the sheets S to the first stacking unit 201 is stopped until the sheets S on the first stacking unit 201 is removed. The control unit 300 performs various operations of the image forming apparatus including conveying of the sheets S in the image forming apparatus.

Next, an operation when an image is printed on both sides of a sheet S will be described. The sheet S is conveyed while being guided to the first sheet conveying path 119, and a rear end of a sheet passes through a distal end of the second conveying path switching member 121. The second conveying path switching member 121 is switched from the position indicated by a solid line in the drawing to a position indicated by a broken line by an actuator (not illustrated) and is held at that position. After that, the rotation direction of the inversion roller 123 and the discharge roller 124 is reversed whereby the sheet S is conveyed to a refeed conveying path 126. The refeed conveying path 126 merges with the conveying guide 109 on the upstream side of the registration roller 110, and the sheet S is conveyed to the image forming unit 101 again.

Next, a configuration of the sheet post-processing device 200 will be described. Reference numeral 202 is a third sheet conveying path and receives a sheet S from the second sheet conveying path 122 and conveys the sheet S. The sheet S conveyed by the third sheet conveying path 202 is discharged to an intermediate processing tray 203. The sheets S discharged to the intermediate processing tray 203 are aligned one by one in respective directions by a width direction alignment unit 204 and a conveying direction alignment unit 205. After a predetermined number of sheets S are stacked on the intermediate processing tray 203, an upstream-side end of the stacked sheet S is pushed by a discharge unit (not illustrated) whereby the stacked sheet S is discharged to and stacked on the second stacking unit 206. The second stacking unit 206 is configured to be movable up and down in an up-down direction (gravity direction). Moreover, when it is desired to perform post-processing such as stapling on the sheet S, after a predetermined number of sheets S are stacked on the intermediate processing tray 203, post-processing is performed using a post-processing unit 207 and the processed sheets are discharged to the second stacking unit 206. A sheet surface detection flag 208 is provided on an upper side of the second stacking unit 206. When the sheet surface detection flag 208 detects that the sheets S are stacked on the second stacking unit 206 up to a predetermined height, the second stacking unit 206 is moved down by a predetermined amount. When the second stacking unit 206 is repeatedly moved down and a sensor (not illustrated) detects that the second stacking unit 206 has reached a lower limit position, a full state is detected. In this case, the control unit 300 does not convey the sheet S to the second stacking unit 206 until the sheets S on the second stacking unit 206 are removed. In the present embodiment, a conveyance reference position is the center of a sheet, and a sheet S is conveyed to the first stacking unit 201 or the second stacking unit 206 so that the central position in a direction (a width direction) orthogonal to the conveying direction thereof follows the conveyance reference position.

The sheet post-processing device 200 is attached to the apparatus body 100 with an interface unit 210 disposed therebetween. A rail (not illustrated) is formed in the interface unit 210, and the sheet post-processing device 200 is detachably attached (attached to or separated from) to the apparatus body 100.

Figure 2A:
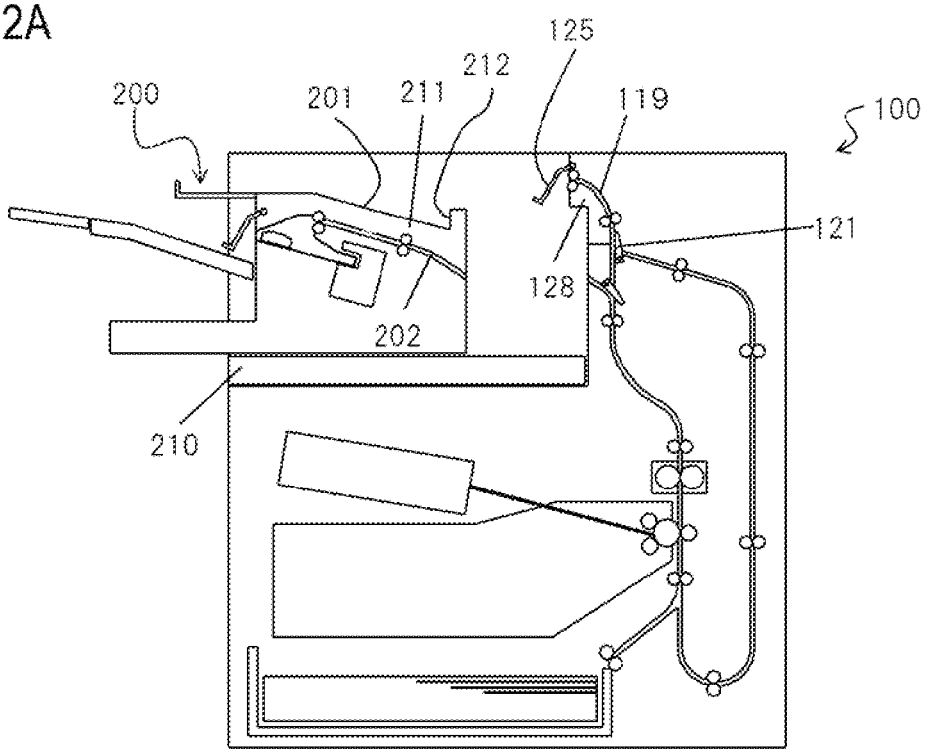
FIGS. 2A and 2B are schematic cross-sectional views of a state in which the sheet post-processing device is separated from the image forming apparatus.
Figure 2B:
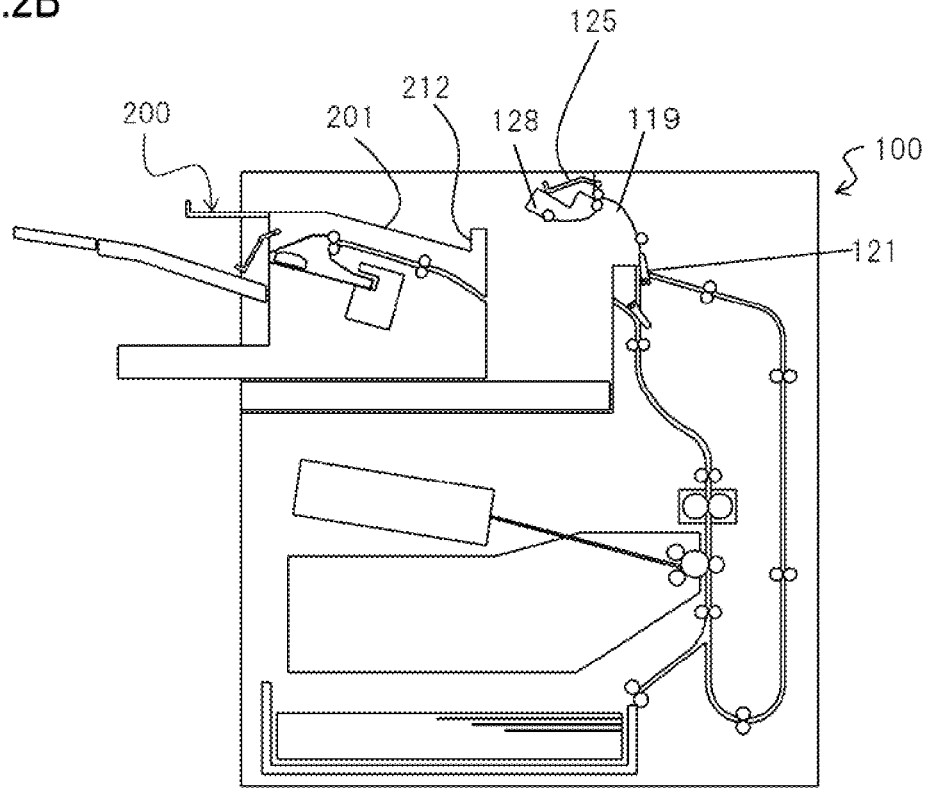

FIG. 2A illustrates a state in which the sheet post-processing device 200 having the first stacking unit 201 and a second rear end wall 212 is moved to be separated from the apparatus body 100. FIG. 2B illustrates a state in which a portion of a conveying guide is released in order to clear a paper jam in a state in which the sheet post-processing device 200 is separated from the apparatus body 100. In the apparatus body 100, a first conveying guide unit 128 is configured to be movable as illustrated in the drawing so that a user can access the first sheet conveying path 119 on the downstream side of the second conveying path switching member 121. When a paper jam clearing operation is to be performed, the first full detection flag 125 is also configured to be movable as illustrated in FIG. 2B and does not prevent movement of the first conveying guide unit 128. In this manner, the sheet post-processing device 200 is separated from the apparatus body 100 to create a space in which the conveying guide unit 128 can move and a space in which a user can access a jammed sheet to remove the jammed sheet. In order to remove a jammed sheet, as illustrated in FIGS. 2A and 2B, a paper jam clearing operation may be performed in a state in which the sheet post-processing device 200 is moved to be separated from the apparatus body 100. Alternatively, the sheet post-processing device 200 may be completely detached from the apparatus body 100 in order to perform the operation more easily.

Figure 3A:
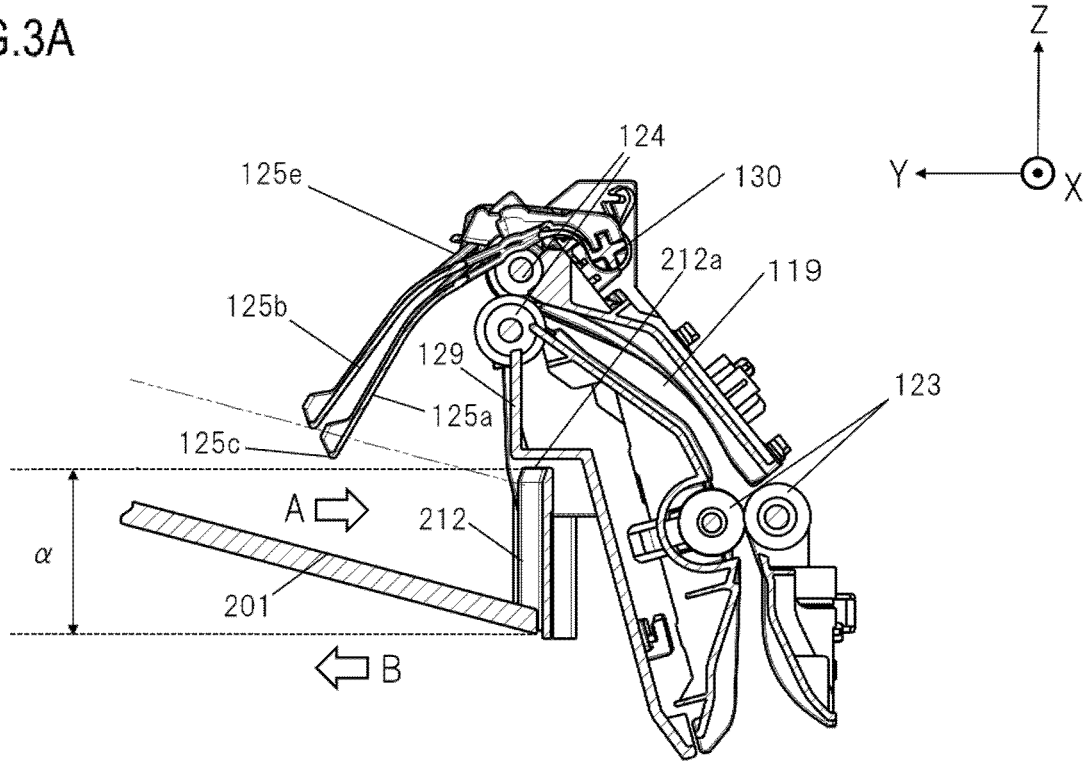
FIGS. 3A and 3B are explanatory diagrams illustrating the periphery of a first stacking unit according to Embodiment 1.
Figure 3B:
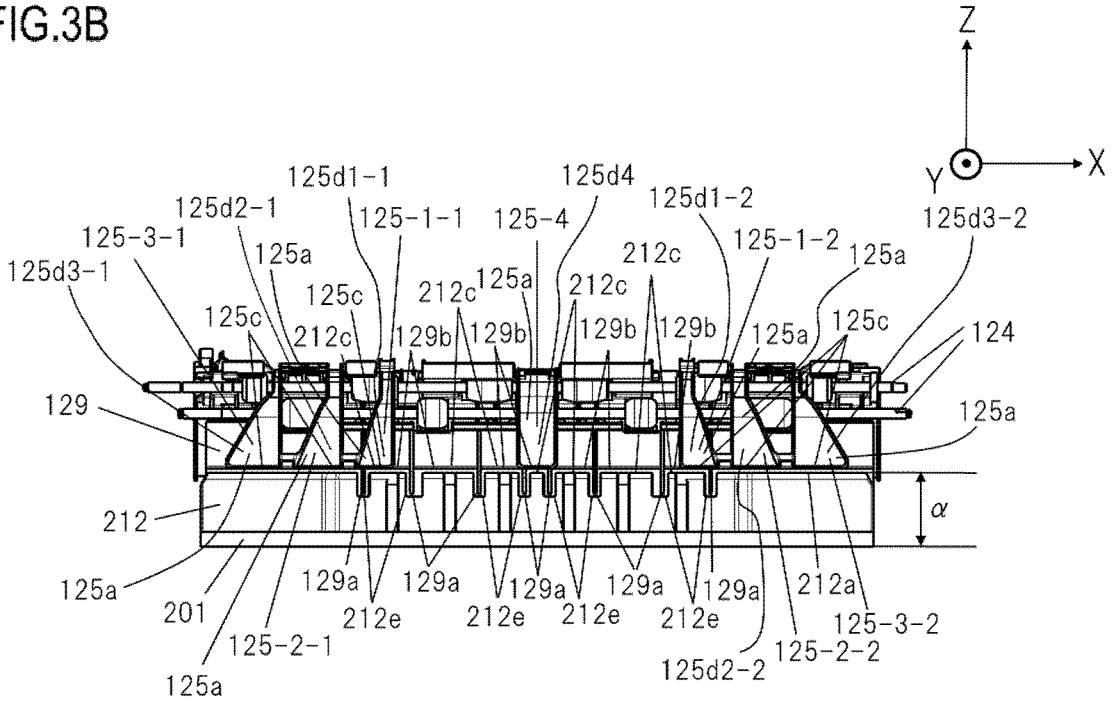

FIG. 3A is a cross-sectional view of the periphery of the first stacking unit 201. FIG. 3B is a left side view of FIG. 3A. A first rear end wall 129 is provided on a lower side of the discharge roller 124 and a second rear end wall 212 is provided on a lower side thereof along an up-down direction. The first rear end wall 129 corresponds to a body-side supporting unit that supports the sheets S stacked on the first stacking unit 201 corresponding to the first supporting unit on the apparatus body side and is configured to be integrated with the first conveying guide unit of the apparatus body 100. The second rear end wall 212 corresponds to a second supporting unit that supports an end of the sheet S stacked on the first stacking unit 201 in an attachment/detachment direction which is a direction in which the sheet post-processing device 200 is attached to and detached from the apparatus body 100. The second rear end wall 212 is configured to be integrated with the first stacking unit 201 of the sheet post-processing device 200. The sheet post-processing device 200 moves in the direction indicated by arrow A illustrated in FIG. 3A when the sheet post-processing device 200 is attached to the apparatus body 100 and moves in the direction indicated by arrow B when the sheet post-processing device 200 is separated therefrom.

As illustrated in FIG. 3B, the second rear end wall 212 is disposed on a lower side of the first rear end wall 129. An up-down direction in which the first rear end wall 129 and the second rear end wall 212 are arranged is orthogonal to an attachment/detachment direction and a sheet width direction in which the sheet post-processing device 200 is attached to and detached from the apparatus body 100. In the present embodiment, the attachment/detachment direction in which the sheet post-processing device 200 is attached to and detached from the apparatus body 100 is indicated by a left-right direction extending along the Y-axis in FIG. 3A, and the sheet width direction is indicated by a left-right direction extending along the X-axis in FIG. 3B. That is, an up-down direction extending along the Z-axis in FIGS. 3A and 3B is a direction orthogonal to the attachment/detachment direction of the sheet post-processing device 200 with respect to the apparatus body 100 and the width direction of the sheet S. A boundary portion (a portion (hereinafter referred to as a dividing portion) having such as shape as to be divided when the sheet post-processing device 200 is detached from the apparatus body 100) has a partially comb-teeth shape. That is, the dividing portion is configured such that a concave-convex portion uneven in an up-down direction, formed in the first rear end wall 129 and a concave-convex portion uneven in an up-down direction, formed in the second rear end wall 212 engage with each other. Specifically, a plurality of body-side convex portions 129*a* protruding downward toward the second rear end wall 212 are formed on the first rear end wall 129 at intervals in the width direction of the sheet S as a convex portion. A plurality of body-side concave portions 129*b* that are depressed upward are formed between the plurality of body-side convex portions 129*a* at intervals in the width direction of the sheet S. On the other hand, a plurality of convex portions 212*c* protruding upward toward the first rear end wall 129 are formed on the second rear end wall 212 as a convex portion at intervals in the width direction of the sheet S. A plurality of concave portions 212*e* that are depressed downward are formed between the plurality of convex portions 212 as a concave portion at intervals in the width direction of the sheet S. The uneven structure of the first rear end wall 129 and the uneven structure of the second rear end wall 212 are configured so that the body-side convex portions 129*a* enter into the concave portions 212*e* and the convex portions 212 enter into the body-side concave portions 129*b*. That is, the body-side convex portions 129*a* of the first rear end wall 129 and the convex portions 212 of the second rear end wall 212 are arranged alternately in the width direction of the sheet S. In this way, a region in which the rear end of the sheet S stacked on the first stacking unit 201 is supported by the second rear end wall 212 only, a region in which the rear end is supported by both the first rear end wall 129 and the second rear end wall 212, and a region in which the rear end is supported by the first rear end wall 129 only are formed sequentially in the stacking direction of the sheets S. In other words, the region in which the rear end of the sheet S stacked on the first stacking unit 201 can be supported by the first rear end wall 129 extends downward in an up-down direction (the stacking direction of the sheets S) so as to overlap the region in which the rear end of the sheet S can be supported by the second rear end wall 212. The advantage of this configuration will be described later.

Reference numeral 125 is a first full detection flag and corresponds to a detection unit as described above. The first full detection flag 125 rotates about a flag rotation center 130 (a rotation axis extending in the width direction of the sheet S). Reference numeral 125*a* illustrated in FIG. 3A indicates the first full detection flag at a home position (that is, an initial position), and reference numeral 125*b* indicates the first full detection flag at a position (hereinafter referred to as a full detection position) at which full stacking of the sheet S is detected. When the sheet S is stacked on the first stacking unit 201, the first full detection flag 125 abuts on the stacked sheet whereby a flag portion at a distal end of the first full detection flag 125 is raised. That is, the position of abutting on the sheet S changes according to the height of the sheets stacked on the first stacking unit 201. Moreover, as illustrated in FIG. 3A, the first full detection flag 125 has a base portion 125*e* serving as arms 125-1-1 to 125-4 (to be described later) formed close to the flag rotation center 130. Furthermore, as illustrated in FIG. 3B, the first full detection flag 125 has arms 125-1-1 to 125-4 extending from the base portion 125*e* close to the flag rotation center 130 toward the surface of the sheet S stacked on the first stacking unit 201 and abuts on a plurality of positions of the sheet S along the width direction thereof. Since the base portion 125*e* is disposed close to the flag rotation center 130, the arms 125-1-1 to 125-4 rotate about the flag rotation center 130. Moreover, the arm 125-4 is formed at the conveyance reference position of the sheet S. Therefore, in the present embodiment, the sheets S are conveyed so that the central position in the width direction of the sheet S is aligned at the position of the arm 125-4. In the present embodiment, the arms 125-1-1 to 125-3-2 are provided in pairs on the outer side of the arm 125-4 in the sheet width direction so as to handle three types of sizes of sheets S. First, a pair of arms 125-1-1 and 125-1-2 is formed on the outer side of the arm 125-4 so as to handle a sheet S having the smallest size among the sizes that can be handled in the present embodiment. An arm 125-2-1 is provided on the outer side of the arm 125-1-1 and an arm 125-2-2 is provided on the outer side of the arm 125-1-2 so as to handle a sheet S (having the second smallest size) having a larger width than the smallest-size sheet S. Furthermore, an arm 125-3-1 is formed on the outer side of the arm 125-2-1 and an arm 125-3-2 is formed on the outer side of the arm 125-2-2 so as to handle a sheet (having the largest size in the present embodiment) having a larger width than the next-smallest-size sheet S.

The distal ends of the arms 125-1-1 to 125-4 abut on the surface the sheet S stacked on the first stacking unit 201 at a plurality of positions as a first abutting portion 125*c*. Moreover, portions of the arms 125-1-1 to 125-4 serving as a surface formed between the first abutting portion 125*c* and the base portion 125*e* close to the flag rotation center 130 are second abutting portions 125*d*1-1 to 125*d*4 abutting on an end in the conveying direction of the sheet S conveyed from the apparatus body. More specifically, the second abutting portion 125*d*1-1 is formed in the arm 125-1-1 and the second abutting portion 125*d*1-2 is formed in the arm 125-1-2. The second abutting portion 125*d*2-1 is formed in the arm 125-2-1 and the second abutting portion 125*d*2-2 is formed in the arm 125-2-2. The second abutting portion 125*d*3-1 is formed in the arm 125-3-1 and the second abutting portion 125*d*3-2 is formed in the arm 125-3-2. The second abutting portion 125*d*4 is formed in the arm 125-4.

The arms 125-1-1 to 125-3-2 of the first full detection flag 125 have a so-called approximately trapezoidal shape such that a width close to the first abutting portion 125*c* is larger than a width close to the base portion 125*e* in the sheet width direction when seen from the attachment/detachment direction. That is, the second abutting portions 125*d*1-1 to 125*d*3-2 which are portions of the arms 125-1-1 to 125-3-2 serving as a surface between the base portion 125*e* and the first abutting portion 125*c* also have an approximately trapezoidal shape when seen from the attachment/detachment direction.

A width in which the sheet S can abut on the second abutting portion according to the size of the sheet S is secured as the width close to the first abutting portion 125*c*, of the second abutting portions 125*d*1-1 to 125*d*3-2 in the sheet width direction. This is true regardless of whether the sheet S moves obliquely at the corners of the ends in the conveying direction of the sheet S.

Therefore, the second abutting portions 125*d*1-1 to 125*d*3-2 can abut on the corner portions of the sheet S regardless of whether the sheet S moves obliquely in the surface portion of the arms 125-1-1 to 125-3-2 extending from the base portion 125*e* to the first abutting portion 125*c*.

However, how the sheet S abuts on the second abutting portions 125*d*1-1 to 125*d*3-2 when the sheet S is conveyed will be described. For example, when the sheet S is conveyed normally, the corner portions of the ends in the conveying direction of the sheet S abut on the second abutting portion corresponding to the size of the sheet S. A portion on the inner side than the corner portion of the end in the conveying direction of the sheet S abuts, substantially simultaneously with the corner portion, on the second abutting portion on the inner side in the sheet width direction than the second abutting portion on which the corner portion of the sheet S abuts. For example, a case in which the corner portion abuts on the second abutting portion 125*d*3-1 and the second abutting portion 125*d*3-2 will be discussed. A portion on the inner side in the sheet width direction than the corner portion of the sheet S abuts on the second abutting portions on the inner side than the two second abutting portions in the sheet width direction.

On the other hand, when the sheet S is conveyed obliquely, a portion on the downstream side in the conveying direction among the corner portions of the sheet S abuts on one of the pair of second abutting portions according to the size of the sheet S. After that, the end in the conveying direction of the sheet S sequentially abuts on the second abutting portion on the inner side in the sheet width direction than the second abutting portion on which the corner portion abuts. Finally, the corner portion of the sheet S which has not abut on the second abutting portion abuts on the other one of the pair of second abutting portions according to the size of the sheet S.

In the present embodiment, due to limitation on the design of the image forming apparatus, the installation location of the components that form the image forming apparatus including the arms of the first full detection flag 125 is limited. Therefore, the location of the base portion 125*e* of the base portion 125*e* of the arms 125-1-1 to 125-3-2 of the first full detection flag 125 is also limited. As a result, the width close to the base portion 125*e* in the sheet width direction of the second abutting portions 125*d*1-1 to 125*d*3-2 is smaller than the width close to the first abutting portion 125*c* in the sheet width direction. Moreover, an inclination when a sheet is conveyed obliquely is different depending on the size of the sheet S. Therefore, in consideration of these facts, the second abutting portions 125*d*1-1 to 125*d*3-2 have the approximately trapezoidal shape as illustrated in FIG. 3B so that the end surface in the conveying direction of the sheet S can abut on the second abutting portion.

Moreover, the width of the second abutting portions 125*d*1-1 to 125*d*3-2 in the sheet width direction increases gradually as it advances outward in the sheet width direction about the position of the second abutting portion 125*d*4 as a boundary. Specifically, the width of the second abutting portion 125*d*2-1 is larger than the width of the second abutting portion 125*d*1-1, and the width of the second abutting portion 125*d*2-2 is larger than the width of the second abutting portion 125*d*1-2. Furthermore, the width of the second abutting portion 125*d*3-1 is larger than the width of the second abutting portion 125*d*2-1, and the width of the second abutting portion 125*d*3-2 is larger than the width of the second abutting portion 125*d*2-2. This is because the displacement of the corner portion of the distal end in the conveying direction of the sheet S when the sheet S moves obliquely increases as the size of the sheet S increases. Therefore, even when the displacement of the corner portion increases, the corner portion of the sheet S can abut on the second abutting portion.

The advantages resulting from the fact that the second abutting portions 125*d*1-1 to 125*d*3-2 are provided in the arms 125-1-1 to 125-3-2 of the first full detection flag 125 will be described.

When the second abutting portion formed in the arm of the first full detection flag 125 has an elongated (narrow) shape, the area of the portion abutting the sheet S decreases, the width that supports the corner of the sheet S decreases, or the abutting portion abuts with a small width at a position displaced from the corner of the end of the sheet S. In this case, the sheet S may be damaged in such a way that force acting on the abutting sheet S may concentrate on a local area and the corner may be folded.

However, in the present embodiment, as described above, an approximately trapezoidal portion of the second abutting portion abuts on the corner portions of the end in the conveying direction of the sheet S regardless of whether the sheet S moves obliquely. Therefore, even when conveying of the sheet S progresses, the second abutting portion continues surface-contact with the sheet S, the force acting on the sheet S is distributed rather than concentrating on a local area and the burden on the sheet S is alleviated. As a result, it is possible to prevent the sheet S from being discharged in a corner-folded state.

The first full detection flag 125 has the plurality of first abutting portions 125*c* arranged along the sheet width direction as described above. That is, the first full detection flag 125 abuts on the stacked sheet S at a plurality of positions rather than one position along the sheet width direction. In the present embodiment, although the first full detection flag 125 abuts on the stacked sheet S at seven positions in total, the number of abutting positions is not limited thereto. The number of portions abutting on the sheet S is not particularly limited as long as the first full detection flag 125 can abut on the stacked sheet S in a wide region while aligning the left and right ends and the central portion in the sheet width direction. For example, the number of portions abutting on the sheet S on each of the left and right sides about the first abutting portion 125*c* at the center may be changed from three to two so that the first full detection flag 125 abuts on the stacked sheet S at five positions in total.

Furthermore, the sheet S stacked on the first stacking unit 201 reaches the highest height of the sheets S stackable on the first stacking unit 201 and the first full detection flag 125 (the first abutting portion 125*c*) is raised to the full detection position. By doing so, the status of a sensor (not illustrated) is switched to detect a full state. Here, in the present embodiment, the full detection position of the first full detection flag 125 is set so that the sensor detects the full state before the height of the rear end (the end on which the second rear end wall 212 abuts) of the sheet S stacked on the first stacking unit 201 exceeds the height α of the second rear end wall 212.

A line indicated by a two-dot chain line in FIG. 3A indicates the height of the sheet S when the full state of the sheet S is detected. That is, when the sheets S are stacked up to the height of the two-dot chain line, conveying of sheets to the first stacking unit 201 is stopped by the control unit 300. In FIG. 3A, a moving trajectory of an upper end surface 212*a* of the second rear end wall 212 is indicated by a broken line. In FIG. 3B, the height of the upper end surface 212*a* in a direction (an up-down direction) orthogonal to the attachment/detachment direction and the sheet width direction of the sheet post-processing device 200 with respect to the apparatus body 100 is indicated by a. When the sheet post-processing device 200 is detachably attached (attached to or separated from) to the apparatus body 100, the upper end surface 212*a* moves along the broken line. During this movement, the upper end surface 212*a* of the second rear end wall 212 as the second supporting unit is configured to be on the lower side than the lowest surface (the first abutting portion 125*c*) of the first full detection flag 125*a* at the home position. That is, the height α of the upper end surface 212*a* is lower than the height of the lowest surface of the first full detection flag 125. The positional relation between the upper end surface 212*a* and the lowest surface of the first full detection flag 125 does not depend on whether the sheet S is stacked on the first stacking unit 201. As illustrated in FIG. 3A, the height of the first full detection flag 125*b* when the full state of the sheets S is detected as indicated by the two-dot chain line is further higher than the first full detection flag 125*a* at the home position. That is, this is because the height of the first full detection flag 125 (the first abutting portion 125*c*) becomes higher than the upper end surface 212*a* of the second rear end wall 212 as the sheets S are stacked.

Due to the above-described configuration, the following advantages are obtained. First, as compared to a configuration in which the second rear end wall 212 remains on the apparatus body and the sheet stacking unit (that is, the first stacking unit 201) only is separated, which is considered as one configuration of a stacking device, the first stacking unit 201 and the second rear end wall 212 are integrated in the present embodiment. Furthermore, the second rear end wall 212 is provided up to a position higher than the height at which the full state of the sheets S is detected. Therefore, even when the sheet post-processing device 200 is separated from the apparatus body 100 in a state in which the sheets S are stacked up to the full-stacking height, falling of a sheet stacked in the space formed due to the separation is prevented. Therefore, it is possible to eliminate the need to removing sheets stacked before the separation operation is performed.

Even when the sheet post-processing device 200 is attached to and separated from the apparatus body 100, the upper end surface 212*a* of the second rear end wall 212 is at a lower position than the lowest surface of the first full detection flag 125 which is a detection unit. Moreover, as illustrated in FIG. 3B, the first full detection flag 125 and the second rear end wall 212 are disposed so as not to overlap each other when seen from the attachment/detachment direction of the sheet post-processing device 200 with respect to the apparatus body 100. Therefore, during movement of the sheet post-processing device 200 with respect to the apparatus body 100, the first full detection flag 125 and the second rear end wall 212 do not make contact with each other, and the first full detection flag 125 is not broken by interfering with the second rear end wall 212.

Although the second rear end wall 212 of the present embodiment has a configuration in which the height (the height of the upper end surface 212*a*) in the entire sheet width direction is lower than the lowest surface of the first full detection flag 125, there is no limitation thereto. That is, a region that agrees with the first full detection flag 125 in the sheet width direction, when seen from the attachment/detachment direction, is defined as a corresponding region of the second rear end wall 212 corresponding to the position of the first full detection flag 125 abuts with the recording material. A region that does not agree with the first full detection flag 125 in the sheet width direction, when seen from the attachment/detachment direction, is defined as a non-corresponding region of the second rear end wall 212 with respect to the first full detection flag 125. When the regions are defined in such a manner, the height of the second rear end wall 212 at least in the corresponding region may be lower than the lowest surface of the first full detection flag 125.

Due to the comb-teeth shape, a region in which the first rear end wall 129 can support the rear end of the sheet S stacked on the first stacking unit 201 may extend downward so as to overlap a region in which the second rear end wall 212 can support the rear end of the sheet S. Due to this configuration, the following advantages are obtained. For example, a portion of the stacked sheets S may climb over the second rear end wall 212 to slip and fall into a gap between the first rear end wall 129 and the second rear end wall 212 due to wind pressure or the like occurring when the sheet post-processing device 200 is separated from the apparatus body 100 in a state in which the sheets S are stacked thereon. In this case, the body-side convex portion 129*a* of the first rear end wall 129 extending further downward than the upper end surface 212*a* of the second rear end wall 212 abuts on the end of the protruding sheet S climbing over the first rear end wall 129, and the sheet S can be prevented from entering further into the gap.

Figure 4A:
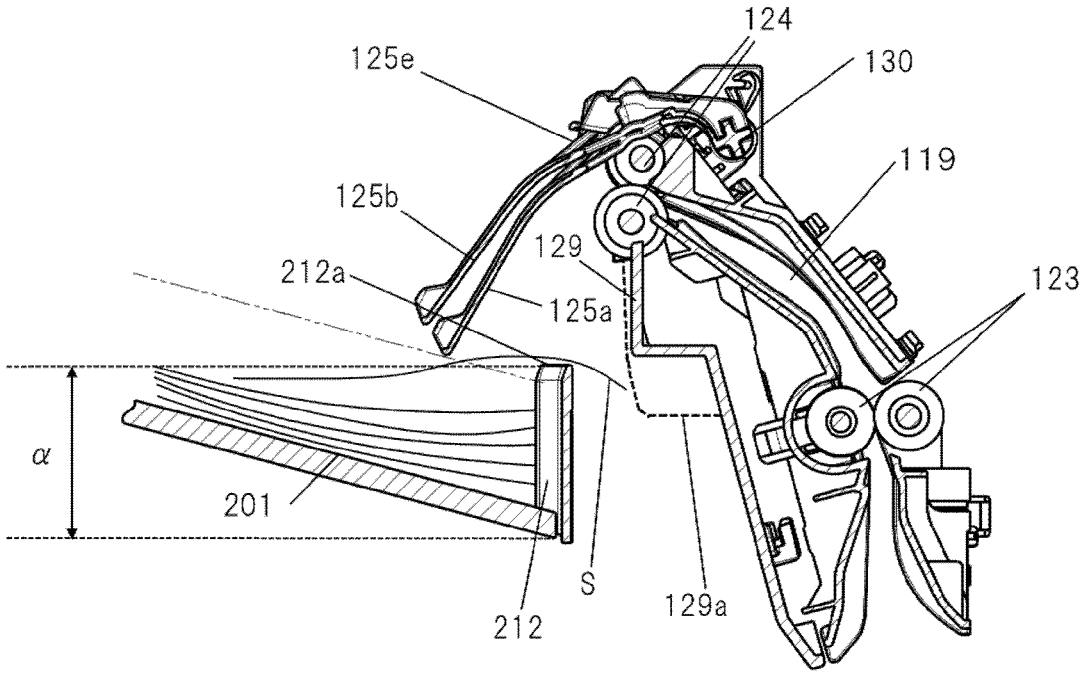
FIGS. 4A and 4B are explanatory diagrams illustrating the periphery of the first stacking unit when a dividing portion does not have a comb-teeth shape.
Figure 4B:
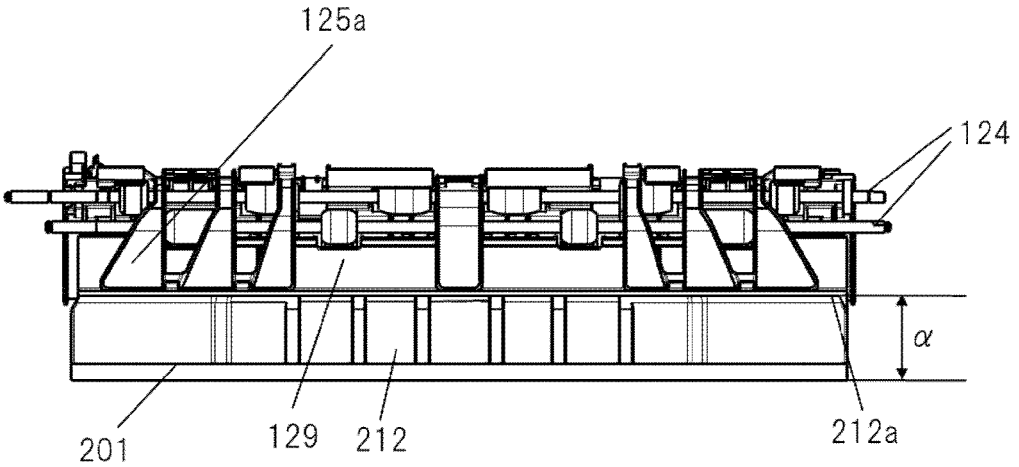

Here, as a comparative example for describing the advantages more easily, explanatory diagrams illustrating the periphery of the first stacking unit 201 when the dividing portion between the first rear end wall 129 and the second rear end wall 212 does not have a comb-teeth shape are illustrated in FIGS. 4A and 4B. FIG. 4A is a cross-sectional view of the periphery of the first stacking unit 201 when the dividing portion does not have a comb-teeth shape (for reference, the configuration of the body-side convex portion 129*a* which is not provided in this comparative example is depicted by a broken line). FIG. 4B is a left side view of FIG. 4A. As illustrated in FIGS. 4A and 4B, if the dividing portion between the first rear end wall 129 and the second rear end wall 212 is flat, the following problem may occur when the sheet post-processing device 200 is separated from the apparatus body 100. That is, the sheet S stacked on the first stacking unit 201 may float due to wind pressure and may enter into a space formed when the sheet post-processing device 200 as illustrated in FIG. 2B is separated from the apparatus body 100 from the gap in the dividing portion.

However, as indicated by a broken line in FIG. 4A, in the dividing portion between the first rear end wall 129 and the second rear end wall 212 of the present embodiment, a portion (the body-side convex portion 129*a*) of the first rear end wall 129 extends so that the sheet S is prevented from entering into the space. That is, due to the body-side convex portion 129*a* formed in the first rear end wall 129, the gap in which the sheet S enters toward the inner side of the dividing portion is not formed, or the gap is small. Therefore, it is possible to prevent the stacked sheet S from entering into the gap in the dividing portion.

Embodiment 2

Figure 5A:
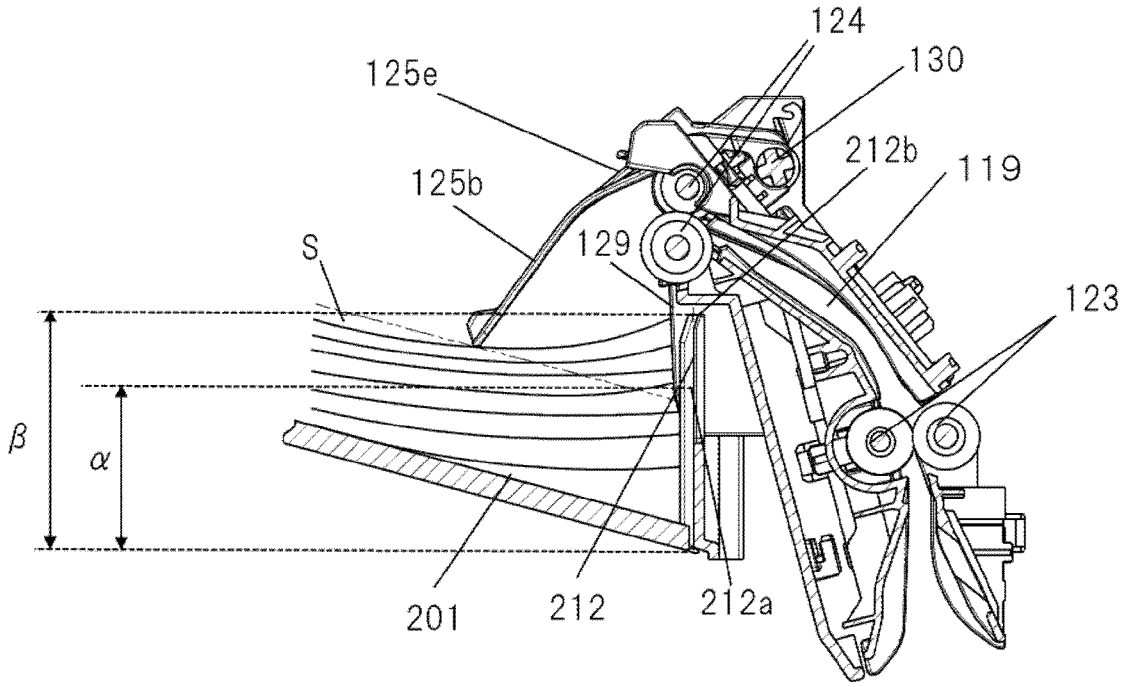
FIGS. 5A and 5B are explanatory diagrams illustrating the periphery of a first stacking unit according to Embodiment 2.
Figure 5B:
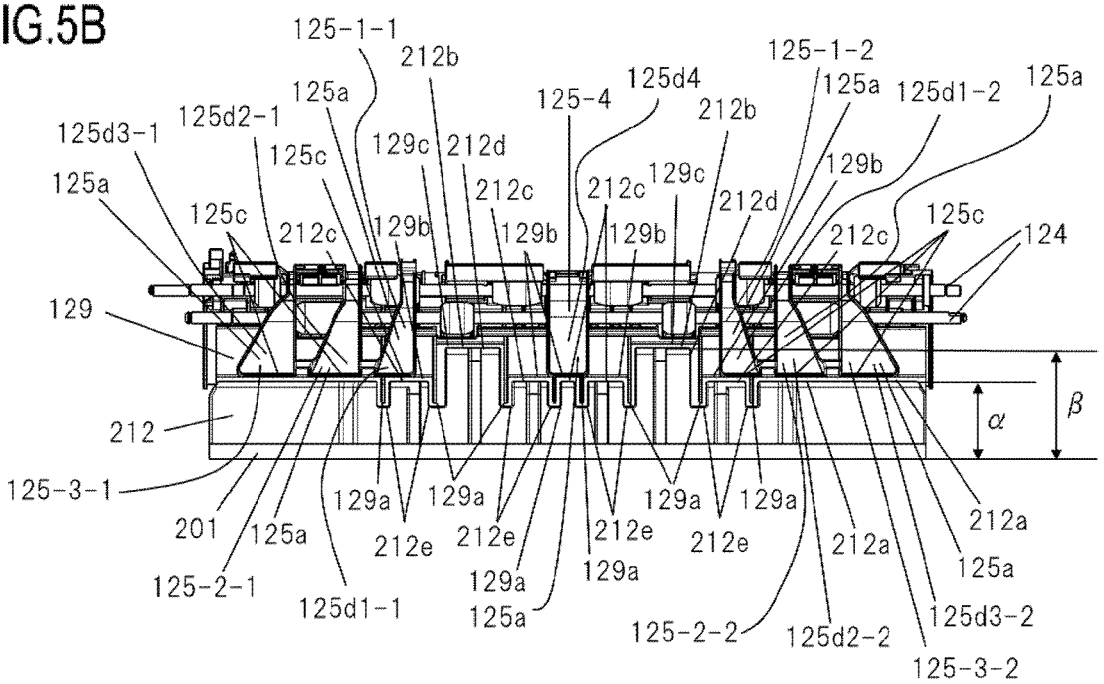

Embodiment 2 will be described with reference to FIGS. 5A and 5B. FIG. 5A is a cross-sectional view of the periphery of the first stacking unit 201 according to the present embodiment. FIG. 5B is a left side view of FIG. 5A. The same configurations as those of Embodiment 1 will be denoted by the same reference numerals and the detailed description thereof will be omitted.

As illustrated in FIG. 5B, in the present embodiment, the second rear end wall 212 forms a wall having two different heights, including a portion having an upper end surface 212*a* having the height of a and a portion having an upper end surface 212*b* having the height of β. The height a of the upper end surface 212*a* is the same as the height of the upper end surface 212*a* illustrated in Embodiment 1 and is lower than the lowest surface of the first full detection flag 125.

As illustrated in FIG. 5B, the first full detection flag 125 has a partially notched shape rather than having a flag portion that abuts on a stacked sheet over an entire sheet width direction. At a position at which the first full detection flag 125 is notched, the second rear end wall 212 has a wall portion having the upper end surface 212*b* having the height of β higher than the height α of the upper end surface 212*a*. On the other hand, at a position at which the first full detection flag 125 has a flag portion (the first abutting portion 125*c*) abutting on the stacked sheet S, the second rear end wall 212 has a wall portion having the upper end surface 212*a* having the height of α.

In Embodiment 2, a comb-teeth shape is partially formed in the dividing portion between the first rear end wall 129 and the second rear end wall 212. The comb-teeth shape of Embodiment 2 is configured such that a body-side concave portion 129*c* deeper than the body-side concave portion 129*b* and a convex portion 212*d* higher (by β-α) than the convex portion 212*c* disposed to enter into the body-side concave portion 129*c* are added to the comb-teeth shape of Embodiment 1.

That is, in a region in the sheet width direction of the second rear end wall 212, a region in which the position of the region in the sheet width direction agrees with the position of the first full detection flag 125 is defined as a corresponding region of the second rear end wall 212 corresponding to the first full detection flag 125 similarly to Embodiment 1. When the region is defined in such a manner, the height of the corresponding region in a direction orthogonal to the attachment/detachment direction and the width direction is lower than the height of the lowest surface of the first full detection flag 125. This height corresponds to the height a of the upper end surface 212*a* in FIG. 5B. Moreover, a region in which the position of the region in the sheet width direction does not agree with the position of the first full detection flag 125 is defined as a non-corresponding region of the second rear end wall 212 with respect to the first full detection flag 125. When the region is defined in such a manner, the non-corresponding region is higher than the height of the lowest surface of the first full detection flag 125. This height corresponds to the height β of the upper end surface 212*b* in FIG. 5B. That is, in the configuration of the present embodiment, the first full detection flag 125 and the second rear end wall 212 are disposed so as not to overlap each other when seen from the attachment/detachment direction of the sheet post-processing device 200 with respect to the apparatus body 100. Therefore, when the sheet post-processing device 200 is attached to or separated from the apparatus body 100, the first full detection flag 125 and the second rear end wall 212 do not interfere with each other.

In the present embodiment, the second rear end wall 212 has the upper end surface 212*b* having the height of β higher than the upper end surface 212*a* having the height of α which corresponds to the maximum height of the stacked sheets S. Due to this configuration, it is possible to stabilize the stacking state of the sheets S.

FIG. 5A illustrates a state in which sheets S curling (hereinafter referred to as leaning and curling) in a direction in which a rear end of the sheet leans against the rear end wall are stacked on the first stacking unit 201. In the drawing, a two-dot chain line indicates the height of the stacked sheets S when the full state of sheets S is detected. Moreover, a broken line indicates the position of the upper end surface 212*b* and the upper end surface 212*a* of the second rear end wall 212. As described above, in the present embodiment, the difference between the height of the upper end surface 212*b* of the second rear end wall 212 and the height of the sheets S when the full state of the sheets S is detected is increased as compared to Embodiment 1.

In such a state, in Embodiment 1, when the sheet post-processing device 200 is detached from the apparatus body 100, since there is no support for the rear end of a sheet, the sheet S stacked on the upper side than the upper end surface 212*a* among the stacked sheets S may slip and fall off the sheet post-processing device 200. In contrast, in Embodiment 2, since the wall portion having the upper end surface 212*b* higher than the upper end surface 212*a* can support the rear end of the curled sheet S stacked on the upper side, it is possible to stabilize the stacking state of the sheets S during attachment/detachment of the sheet post-processing device 200.

Figure 6A:
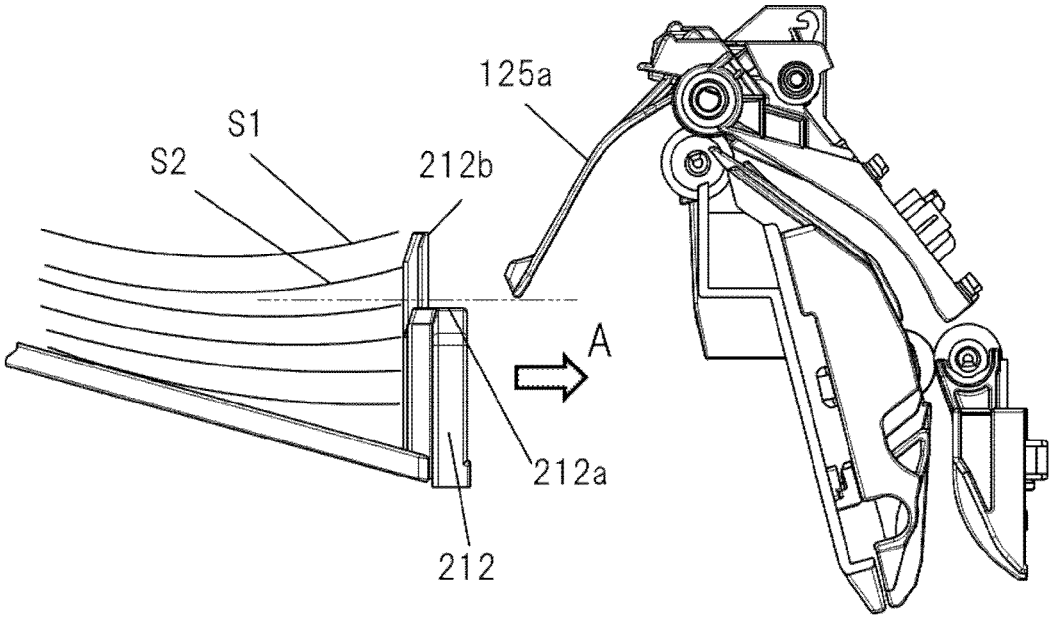
FIGS. 6A and 6B are explanatory diagrams illustrating a process in which a sheet post-processing device is attached to an apparatus body according to Embodiment 2.
Figure 6B:
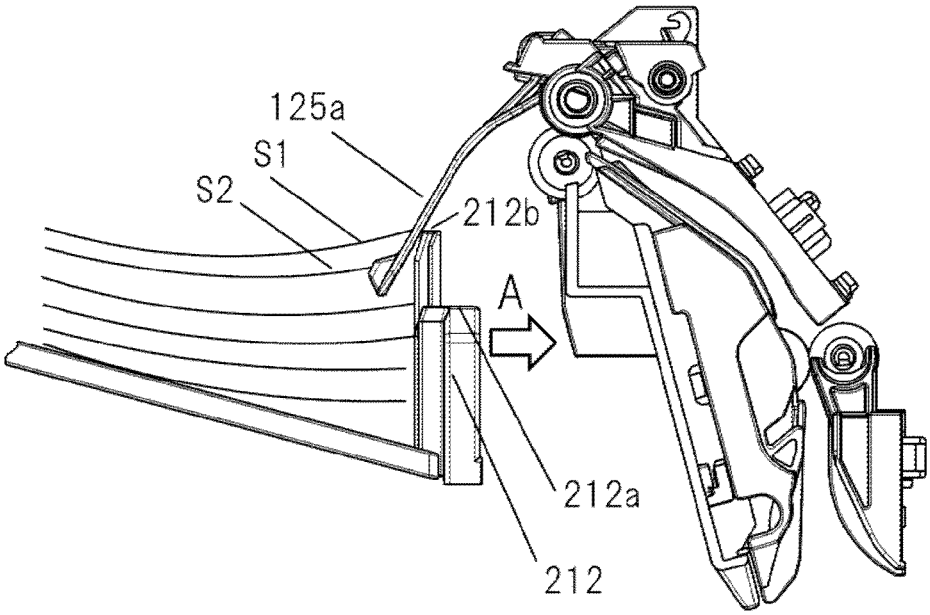

FIGS. 6A and 6B illustrate an intermediate state in which the sheet post-processing device 200 is to be attached to the apparatus body 100 in a state in which leaning-curled sheets are stacked up to the full state. FIG. 6A illustrates a state before the upper end surface 212*b* passes through a lateral side of the first full detection flag 125, and FIG. 6B illustrates a state after the upper end surface 212*b* passes through a lateral side of the first full detection flag 125. As described above, the first full detection flag 125 and the second rear end wall 212 do not interfere each other. However, some sheets (S1 and S2 in the drawing) stacked on the upper side may make contact with the first full detection flag 125. However, only several sheets may ride on the first full detection flag 125 and there is little possibility that the first full detection flag 125 will be broken.

As described above, in the present embodiment, the difference between the height of the upper end surface of the second rear end wall 212 and the height when the full state of sheets S is detected is larger than that of Embodiment 1. Due to this, even when sheets S of which the rear end leans and curls are stacked on the first stacking unit 201, advantages similar to the advantages mentioned in Embodiment 1 are obtained.

A remarkable advantage unique to Embodiment 2 is obtained even when no curl occurs in the stacked sheet S. For example, in addition to the advantage of the comb-teeth shape of the dividing portion between the first rear end wall 129 and the second rear end wall 212 described in Embodiment 1, since the height of the upper end surface 212*b* is high, it is possible to prevent the sheet S from riding over the second rear end wall 212. According to Embodiment 2, it is not necessary to set the upper-limit height of the maximum number of stackable sheets S to the height of the upper end surface 212*a*, and it is possible to increase the largest number of stackable sheets S as compared to Embodiment 1.

Embodiment 3

Figure 7A:
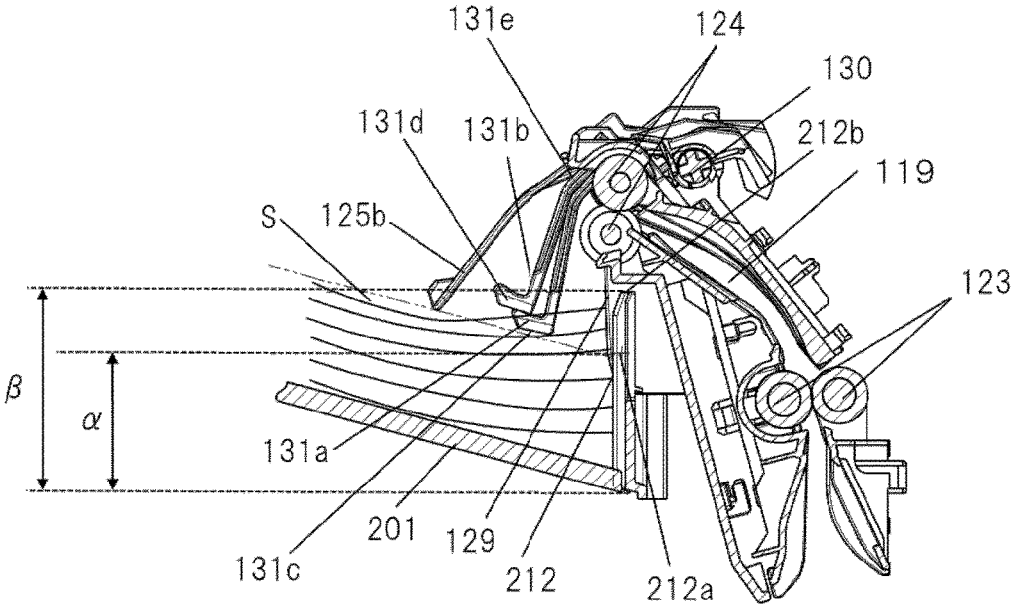
FIGS. 7A and 7B are explanatory diagrams illustrating the periphery of a first stacking unit according to Embodiment 3.
Figure 7B:
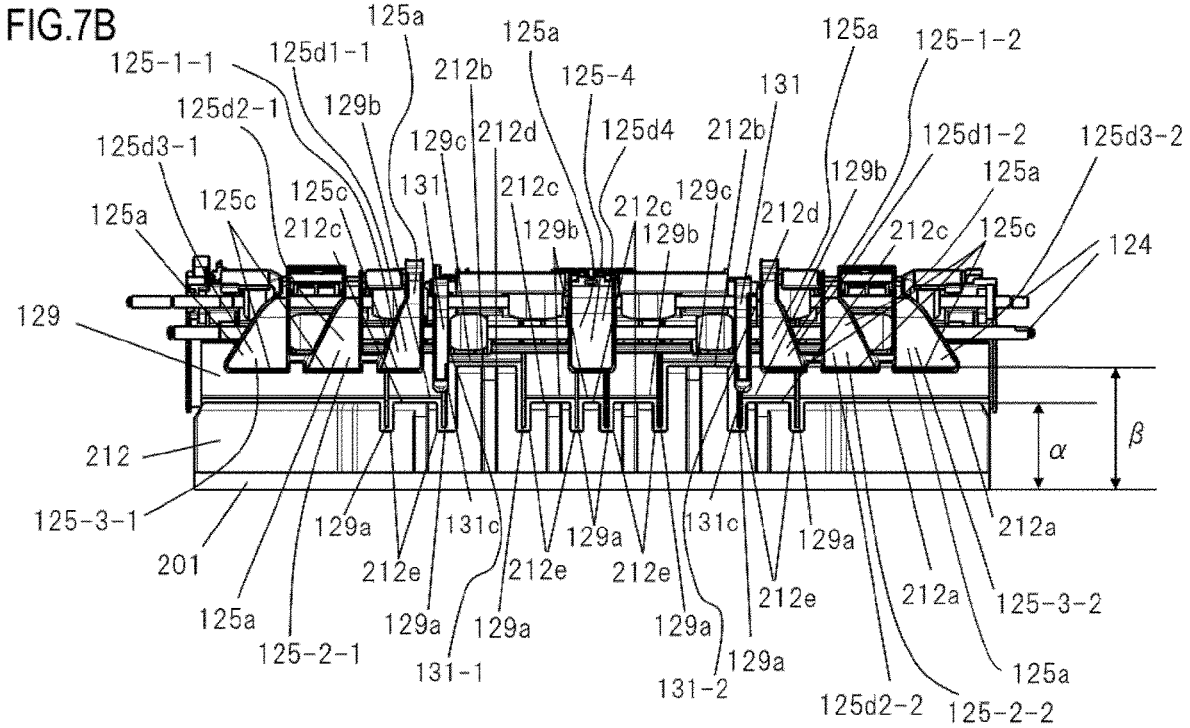

Embodiment 3 will be described with reference to FIGS. 7A and 7B. FIG. 7A is a cross-sectional view of the periphery of the first stacking unit 201 according to the present embodiment. FIG. 7B is a left side view of FIG. 7A. The same configurations as those of Embodiments 1 and 2 will be denoted by the same reference numerals and the detailed description thereof will be omitted.

As illustrated in FIG. 7B, in the present embodiment, the second rear end wall 212 forms a wall having two different heights, including a portion having an upper end surface 212*a* having the height of α and a portion having an upper end surface 212*b* having the height of β similarly to Embodiment 2. The height α of the upper end surface 212*a* is the same as the height of the upper end surface 212*a* illustrated in Embodiments 1 and 2 and is lower than the lowest surface of the first full detection flag 125. The height β of the upper end surface 212*b* is the same as the height of the upper end surface 212*b* illustrated in Embodiment 2 and is higher than the height a of the upper end surface 212*a*. Similarly to Embodiment 2, at a position at which the first full detection flag 125 is notched, the second rear end wall 212 has a wall portion having an upper end surface 212*b* having a height of β higher than the height α of the upper end surface 212*a*.

In the present embodiment, the first full detection flag 125 is a first detection unit, and a second full detection flag 131 corresponding to a second detection unit is further included. An abutting position of the second full detection flag 131 abutting on the upper surface of the sheet S at the top of the stacked sheets S is on the side (the side close to the second rear end wall 212) closer to the rear end of the sheet S than the first full detection flag 125 in the conveying direction (the attachment/detachment direction of the sheet post-processing device 200) of the sheets S. In the present embodiment, a pair of second full detection flags 131 is provided on the outer side of the arm 125-4 of the first full detection flag 125 in the sheet width direction and abuts on the sheet S at two positions in the width direction of the sheet S. Regarding the position in the sheet width direction, the second full detection flag 131 is provided at a position which agrees with the upper end surface 212*a* at which the height of the second rear end wall 212 is α.

In FIG. 7A, reference numeral 131*a* indicates the second full detection flag 131 at a home position, and reference numeral 131*b* indicates a flag at a position at which the full state of the sheets S is detected. The second full detection flag 131 rotates about the flag rotation center 130 (the rotation axis extending in the width direction of the sheet S). When a sheet S is stacked on the first stacking unit 201, the distal end (the abutting portion 131*c*) of the second full detection flag 131 is raised by the stacked sheet S. When the flag distal end (the abutting portion 131*c*) is raised up to the full detection position, the status of a sensor (not illustrated) is switched and a full state is detected. Moreover, in the second full detection flag 131, similarly to the first full detection flag 125, arms 131-1 and 131-2 extend from the base portion 131*e* close to the flag rotation center 130 toward the sheets S stacked on the first stacking unit 201. The distal ends of the arms 131-1 and 131-2 are the abutting portion 131*c*.

The control unit 300 stops conveying sheets to the first stacking unit 201 when a sensor detects that sheets S are fully stacked on the first stacking unit 201 using at least the first full detection flag 125 or the second full detection flag 131.

Here, the function of the second full detection flag 131 will be described.

The second full detection flag 131 is provided to more accurately detect the state of a portion closer to the rear end than the abutting position at which the first full detection flag 125 abuts on the sheet S stacked on the first stacking unit 201, which cannot be detected by the first full detection flag 125. More specifically, for example, as illustrated in FIG. 7A, the second full detection flag 131 is provided to detect the state of the sheet S more accurately when the side of the sheet S stacked on the first stacking unit 201 located closer to the rear end than the abutting position of the first full detection flag 125 is curled. As described above, the abutting position between the second full detection flag 131 and the sheet S stacked on the first stacking unit 201 is located at the position closer to the rear end of the sheet S in the conveying direction of the sheet S than the abutting position between the first full detection flag 125 and the sheet S. Therefore, it is possible to detect the state of the portion located closer to the rear end than the abutting position between the sheet S and the first full detection flag 125 more accurately.

When the portion close to the rear end of the sheet S stacked on the first stacking unit 201 abuts on the second full detection flag 131 and the abutting portion 131*c* is raised up to the full detection position, the status of the sensor changes to detect the full state, and the conveying of sheets is stopped.

The second full detection flag 131 has a bent portion 131*d* in a portion close to the abutting portion 131*c* which is the distal ends of the arms 131-1 and 131-2. The bent portion 131*d* is bent from a position displaced from a predetermined attachment position of the sheet post-processing device 200 with respect to the apparatus body 100 in a direction opposite to the direction of returning to the predetermined attachment position. Furthermore, even when the rear end of the sheet S stacked on the first stacking unit 201 abuts on the second full detection flag 131 when the second full detection flag 131 is at the home position (the initial position), the bent portion 131*d* is bent from the portion close to the abutting portion 131*c* with such an angle and length that the rear end of the stacked sheet S does not ride on the second full detection flag 131. In other words, the bent portion 131*d* is bent from the portion close to the abutting portion 131*c* with such an angle and length that, when the sheet post-processing device 200 is attached again, the abutting portion 131*c* is raised by abutting on the sheet S stacked on the first stacking unit 201 to abut on the upper surface of the sheet S stacked at the top.

The advantage of the bent portion 131*d* will be described. For example, a case in which the sheet post-processing device 200 in which sheets S are stacked on the first stacking unit 201 up to a height that the sheet S abuts on the abutting portion 131*c* of the second full detection flag 131 is attached again by being displaced from a predetermined attachment position with respect to the apparatus body 100 will be discussed. In such a case, if the bent portion 131*d* is not present, the rear end of the sheet S stacked on the first stacking unit 201 may ride on the second full detection flag 131.

However, if the bent portion 131*d* is present, it is possible to prevent the rear end of the sheet S stacked on the first stacking unit 201 from riding on the second full detection flag 131 when the sheet post-processing device 200 is attached again. Therefore, it is possible to eliminate the effort of a user, for example, to returning the sheet S riding on the second full detection flag 131 back to the original position of the first stacking unit 201 when the user attaches the sheet post-processing device 200 again from the position displaced from the predetermined attachment position with respect to the apparatus body 100.

As illustrated in FIG. 7B, the shape of the arms 131-1 and 131-2 of the second full detection flag 131 is not an approximately trapezoidal shape unlike the arms 125-1-1 to 125-3-2 of the first full detection flag 125. The first full detection flag 125 is disposed so as to be aligned with respect to the width of the sheet S and the position of the corner of the end in the conveying direction of the sheet S as a countermeasure against the corner folding of the sheet S and has an approximately trapezoidal shape having a width such that the first full detection flag 125 abuts on the corner even when the sheet S moves obliquely. In contrast, the second full detection flag 131 is provided to more accurately detect the state of a portion closer to the rear end than the abutting position at which the first full detection flag 125 abuts on the sheet S stacked on the first stacking unit 201, which cannot be detected by the first full detection flag 125. That is, the purpose of the second full detection flag 131 is different from that of the first full detection flag 125, and the second full detection flag 131 does not need to abut on the corner of the sheet S and does not need to be aligned with respect to the width of the sheet S.

Next, how the full detection position of the second full detection flag 131 is set will be described with reference to FIG. 7A.

First, when stacked sheets S are flat, since the second full detection flag 131 is at the home position as a second full detection flag 131*a* and is slightly above the portion indicated by a two-dot chain line in FIG. 7A, the second full detection flag 131 does not abut on the sheet S. That is, before the second full detection flag 131 abuts on the sheet S, the full state is detected by the first full detection flag 125 and conveying of sheets is stopped. On the other hand, when the stacked sheets S are leaning-curled, as illustrated in FIG. 7A, for example, the second full detection flag 131 may abut on the sheet S before the first full detection flag 125 abuts on the sheet S. When the curled sheets S are stacked continuously, the rear end of the sheet S may climb over the height of the upper end surface 212*b* of the second rear end wall 212. The full position of the second full detection flag 131 is set so that the status of a sensor is switched to stop conveying of sheets before such a state is created.

As illustrated in FIG. 7A, a case in which leaning-curled sheets S are stacked on the first stacking unit 201 will be discussed. In the present embodiment, an abutting position between the stacked sheet and the second full detection flag 131 is located closer to an end of a sheet supported by the second rear end wall 212 than the abutting position between the stacked sheet and the first full detection flag 125. Therefore, when sheets are curled so as to lean against the second rear end wall 212, the second full detection flag 131 detects the full state before the first full detection flag 125 detects the full state. As illustrated in FIG. 7B, the lowest surface of the second full detection flag 131*a* at the home position is set to a higher position than the upper end surface 212*a* of the second rear end wall 212 similarly to the first full detection flag 125*a*. Therefore, even when the sheet post-processing device 200 is attached to and detached from the apparatus body 100, the first full detection flag 125*a* and the second full detection flag 131*a* do not interfere with the second rear end wall 212.

In Embodiments 1 and 2, the first full detection flag 125 only is provided as a flag that detects whether the sheets S are fully stacked on the first stacking unit 201, and the height state of the stacked sheet S can be detected at only one position in the conveying direction of the sheet S. Therefore, for example, when the curling state of the sheet S is weaker than the extent illustrated in FIGS. 5A and 5B and the side closer to the rear end than the abutting position of the first full detection flag 125 is curled, there is a possibility that the curling state is not detected by the first full detection flag 125. That is, there is a problem that it is difficult to understand whether the side of the sheet S closer to the rear end than the abutting position of the first full detection flag 125 is curled so that the height of the rear end exceeds the height of the second rear end wall 212. Therefore, in the present embodiment, the second full detection flag 131 is provided at a position close to the end of the sheet supported by the second rear end wall 212. By doing so, it is possible to detect the state of a stacked sheet more accurately and to detect the full state more reliably.

As described above, the following advantages are obtained due to the configuration of the present embodiment. When the second full detection flag 131 is provided further as described above, it is possible to detect the state of a stacked sheet more accurately and to detect the full state more reliably. Moreover, similarly to Embodiments 1 and 2, during attachment and detachment of the sheet post-processing device 200, the first full detection flag 125 and the second full detection flag 131 do not make contact with the second rear end wall 212 and will not be broken by interfering with the second rear end wall 212. Furthermore, due to the advantage of the comb-teeth shape of the dividing portion between the first rear end wall 129 and the second rear end wall 212 similarly to Embodiments 1 and 2, it is possible to prevent a sheet from falling in a space formed when the sheet post-processing device 200 is separated from the apparatus body 100.

A scene in which the sheet post-processing device 200 is attached to the apparatus body 100 in a state in which the leaning-curled sheets S are stacked up to the full state will be considered. In this case, the occurrence rate of a phenomenon in which a portion of the stacked sheet rides on the full detection flag or the number of riding sheets can be decreased as compared to the configuration of Embodiment 2. Naturally, the first full detection flag 215 and the second full detection flag 131 will not be broken when the sheet post-processing device 200 is attached to and detached from the apparatus body 100.

Figure 8A:
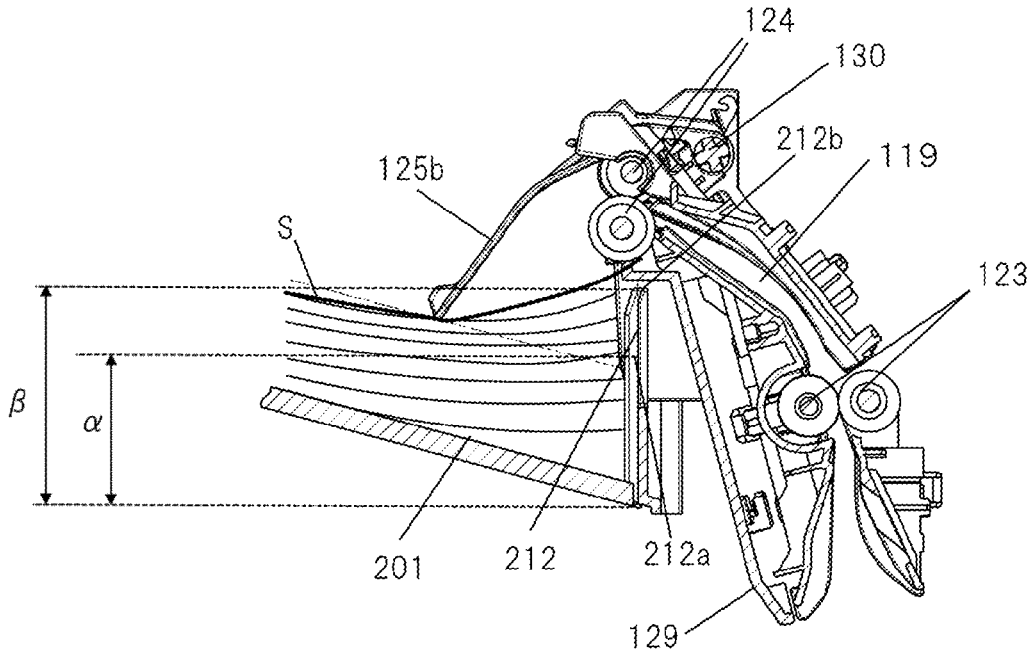
FIGS. 8A and 8B are explanatory diagrams illustrating a state which can occur when the second full detection flag 131 is not present.
Figure 8B:
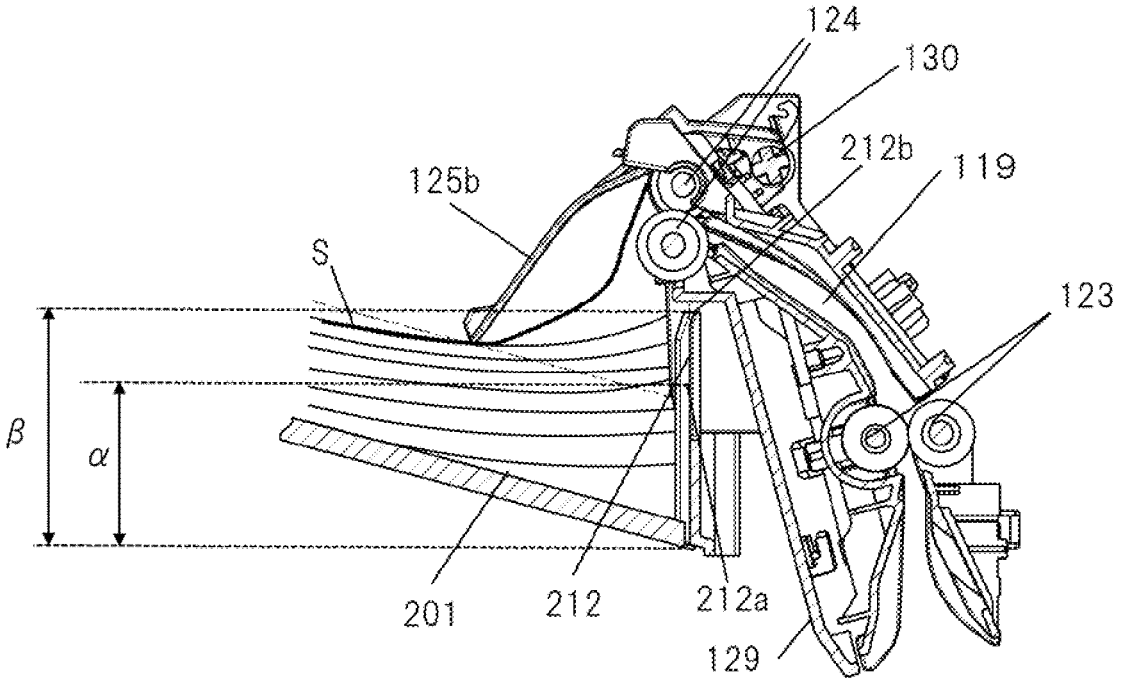

Furthermore, the following advantages are obtained even when the rear end of a stacked sheet leans against the rear end wall 212. The advantages will be described with reference to FIGS. 8A and 8B illustrating a state which can occur when the second full detection flag 131 is not present. The following occasions may occur as an example if the second full detection flag 131 is not present and it is not possible to detect the state of a portion of the sheet S closer to the rear end than the abutting position between the sheet S and the first full detection flag 125. A first occasion is that, as illustrated in FIG. 8A, the rear end of the sheet S stacked on the first stacking unit 201 rolls into a gap between the first rear end wall 129 and a lower roller of the discharge roller 124. A second occasion is that, as illustrated in FIG. 8B, the rear end of the sheet S stacked on the first stacking unit 201 blocks a discharge opening of the discharge roller 124. In FIGS. 8A and 8B, the sheet S which causes the above-mentioned problems is indicated by a bold line. However, as in the present embodiment, when the second full detection flag 131 is further provided, the second full detection flag 131 is raised up to the full detection position (reference numeral 131*b*) before such a state is created. Therefore, a sensor can detect the full state and stop conveying of sheets. That is, the second full detection flag 131 detects the state of the sheet S more accurately and stops conveying of sheets before a portion of the sheet S closer to the rear end than the abutting position between the sheet S and the first full detection flag 125 is stacked up to a position higher than the height β of the upper end surface 212*b*. Therefore, it is possible to prevent occurrence of problems such as a paper jam. The "full state" mentioned herein is a state in which stacking of an additional sheet S on the first stacking unit 201 is not allowed, and the number of stacked sheets S considered to be the "full state" is different depending on the curling state of the sheet S. That is, a larger number of sheets are stacked if the sheet S is flat without any curl, and the number of stacked sheets decreases as the curl size increases.

While the present invention has been described with reference to Embodiments 1 to 3, an application of the present invention is not limited to a stacking device which is attached to and detached from an apparatus body including a detection flag that detects the height of stacked sheets. For example, the present invention can be applied to a stacking device which is attached to and detached from an apparatus body including an abutting member that abuts on the stacked sheet from the upper side to press the sheet in order to stabilize the state of sheets stacked on the stacking device.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-155806, filed on Aug. 22, 2018, which is hereby incorporated by reference herein in its entirety.

What is claimed is:

1. An image forming apparatus comprising:

an apparatus body:

an image forming unit configured to form an image on a recording material;

a conveying device configured to convey the recording material:

a stacking device on which the recording material discharged from the apparatus body is stacked, the stacking device configured to be detachably attached to the apparatus body, the stacking device including a first supporting unit configured to support the recording material from a lower side of the recording material and a second supporting unit configured to support an end of the recording material in an attachment/detachment direction in which the stacking device is attached to and detached from the apparatus body;

a control unit configured to control conveying of the recording material in the image forming apparatus;

a first abutting member configured to abut on the recording material stacked on the stacking device; and a second abutting member configured to abut on the recording material stacked on the stacking device such that an abutting position between the second abutting member and the recording material is located closer to the end supported by the second supporting unit than an abutting position between the first abutting member and the recording material, wherein the control unit is configured to control conveying of the recording material in the image forming apparatus so that the conveying of the recording material to the stacking device is stopped when either one of the first abutting member or the second abutting member abuts on the recording material at a maximum height position at which the recording material can be supported by the second supporting unit in a direction orthogonal to the attachment/detachment direction and the width direction of the recording material.

2. The image forming apparatus according to claim 1, wherein the first abutting member and the second abutting member do not interfere with the stacking device when the stacking device moves in relation to the apparatus body.

3. The image forming apparatus according to claim 1, wherein the second supporting unit is disposed so that the second supporting unit does not overlap with the first abutting member and the second abutting member when seen from the attachment/detachment direction.

4. The image forming apparatus according to claim 1, wherein the first abutting member is configured to be raised from a first home position by contacting the stacked recording material, wherein the second supporting unit includes a first corresponding region and a position of the first corresponding region in the width direction agrees with a position of the first abutting member abutting the recording material in a width direction which is orthogonal to the attachment/detachment direction when the stacking device is attached to the apparatus body, and a height of the first corresponding region in a direction orthogonal to the attachment/detachment direction and the width direction is lower than the height of the lowest portion of the first abutting member when the stacking device is attached to the apparatus body and the first abutting member is in the first home position.

5. The image forming apparatus according to claim 4, wherein the second abutting member is configured to be raised from a second home position by contacting the stacked recording material, wherein the second supporting unit includes a second corresponding region and a position of the second corresponding region in the width direction agrees with a position of the second abutting member abutting the recording material in the width direction when the stacking device is attached to the apparatus body, and a height of the second corresponding region in the direction orthogonal to the attachment/detachment direction and the width direction is lower than the height of the lowest portion of the second abutting member when the stacking device is attached to the apparatus body and the second abutting member is in the second home position.

6. The image forming apparatus according to claim 5, wherein the second supporting unit has a non-corresponding region in which a position of the non-corresponding region in the width direction does not agree with positions of the first abutting member and the second abutting member, and wherein if the recording material is at a position corresponding to a maximum height of stackable recording materials, a height of the non-corresponding region in the direction orthogonal to the attachment/detachment direction and the width direction is higher than (i) a height of the abutting position between the first abutting member and the recording material and (ii) a height of the abutting position between the second abutting member and the recording material.

7. The image forming apparatus according to claim 1, further comprising:

a body-side supporting unit provided in the apparatus body so as to support an end of the recording material, which is stacked on the stacking device, in the attachment/detachment direction, wherein the second supporting unit is disposed on a lower side in the height direction in relation to the body-side supporting unit, wherein the second supporting unit includes a plurality of convex portions formed at intervals along the width direction of the recording material orthogonal to the attachment/detachment direction so as to protrude toward the body-side supporting unit, wherein the body-side supporting unit includes a plurality of body-side convex portions provided at intervals along the width direction so as to protrude toward the second supporting unit, and wherein the plurality of convex portions and the plurality of body-side convex portions are arranged alternately in the width direction.

8. The stacking device according to claim 1, wherein the second supporting unit is configured to abut a rear end of the recording material stacked on the first supporting unit.

* * * * *